United States Patent [19]

Shirasawa

[11] Patent Number: 4,810,230

[45] Date of Patent: Mar. 7, 1989

[54] COIN DISPENSER

[75] Inventor: Masaharu Shirasawa, Tochigi, Japan

[73] Assignee: Universal Co., Ltd., Tochigi, Japan

[21] Appl. No.: 120,142

[22] Filed: Nov. 13, 1987

[30] Foreign Application Priority Data

Nov. 14, 1986 [JP] Japan ..... 61-173907

[51] Int. Cl.[4] ..... G07D 1/00

[52] U.S. Cl. ..... 453/57; 221/203

[58] Field of Search ..... 453/6, 10, 12, 57; 221/203

[56] References Cited

U.S. PATENT DOCUMENTS 4,148,331 4/1979 Nicolaus ..... 453/57 X
4,441,515 4/1984 Goepner ..... 221/203 X
4,574,824 3/1986 Paulsen et al. ..... 453/57

FOREIGN PATENT DOCUMENTS 2359466 2/1978 France ..... 453/57

*Primary Examiner*—F. J. Bartuska
*Attorney, Agent, or Firm*—Staas & Halsey

[57] ABSTRACT

A coin dispenser which includes a coin accommodating bucket having an opening formed at the bottom, a rotary disc disposed under the bucket so as to be rotated substantially horizontally for moving coins, which are supplied from the bucket through the opening, outside by a centrifugal force, a guide for receiving the fringes of the coins moved outside due to the rotation of the rotary disc and for inducing the coins to an outlet, a regulating board for receiving the coins in the bucket above the opening, and an elastic stirring member having a non-circular cross section which is rotated together with the rotary disc in the opening of the bottom of the bucket. The elastic member collides with the coins and flips them so that the coins are stirred, thus preventing the clogging of coins.

3 Claims, 3 Drawing Sheets

COIN DISPENSER

BACKGROUND OF THE INVENTION

1. Field of the Invention

The present invention relates to a coin dispenser which is used for sending out coins or medals (hereinafter, referred to inclusively as coins) to an exhaust in an automat, an exchanger, or a game machine such as a slot machine in which coin-shaped medals are used in particular, it relates to a coin dispenser in which a disc is rotated horizontally so as to pay out coins due to the centrifugal force thereby.

2. Description of the Related Art

In a conventional coin dispenser, a rotary disc driven by a motor is disposed inclined at an angle of, for example, about 80° from horizontal plan in a bucket accommodating a large number of coins to be payed out. Thus, the weight of the coins in the bucket is applied directly to under side of the rotary disc to impart a large load an the rotary disc, resulting in difficulty of improvement of coin dispensation efficiency.

Under such circumstances, there has been proposed a coin dispenser in which the rotary disc is driven at a high speed and coin-pay out efficiency is greatly improved by rotating a rotary disc horizontally and paying out coins due to centrifugal force thereby.

This coin dispenser comprises a coin accommodating bucket having an opening at the bottom, a rotary disc rotatable substantially horizontally under the bucket, a guide for receiving the fringes of coins and inducing the coins to an exhaust, a regulating board for receiving the coins in the bucket over the opening, and a shaft for supporting the regulating board. In this coin dispenser, a large number of coins accommodated in the bucket are received by the regulating board so that a load due to the weight of the coins is not applied directly to the rotary disc and the rotary disc can rotate independently even if the regulating board is surrounded by coins. Further, a projection extending longitudinally or radially is provided at the position above the rotary disc and under the opening of the bottom of the bucket. The coins are stirred by the projection to prevent clogging of coins, which is apt to occur near the opening of the bucket.

In the coin dispenser having a projection as mentioned above, however, a considerable torque is required in order to stir the coins entering under the regulating board by means of the projection, even if a large number of coins accommodated in the bucket are caught by the regulating board, so that the driving mechanism is burdened. Also, since the coins are accumulated one above another, and since space is limited near the bottom opening of the bucket, a pinching phenomenon may occur. In other words, the projection may impinge upon the accumulated coins and becomes impossible to move. Thus, the coin dispenser has problems which include the requirement of an increased load of the driving mechanism and the pinching or biting of the projection into the coins, since the projection is provided for preventing clogging due to the coins near the opening of the bucket.

SUMMARY OF THE INVENTION

An object of the present invention is to provide a coin dispenser which can stir coins with less torque than in the case where the projection is provided for preventing clogging of coins which is apt to occur near the opening of the bucket, and also can prevent the occurrence of biting into coins.

According to the present invention, there is provided a coin dispenser which comprises a coin accommodating bucket having an opening formed at the bottom, a rotary disc disposed under the bucket so as to be rotated substantially horizontally for moving coins, which are supplied from the bucket through the opening, outside by a centrifugal force, a guide for receiving the fringes of the coins moved outside due to the rotation of the rotary disc and for inducing the coins to an outlet, a regulating board for receiving the coins in the bucket above the opening and an elastic member having a non-circular cross section which is rotated together with the rotary disc in the opening of the bottom of the bucket.

DETAILED DESCRIPTION OF THE PREFERRED EMBODIMENT OF THE INVENTION

Figure 1:
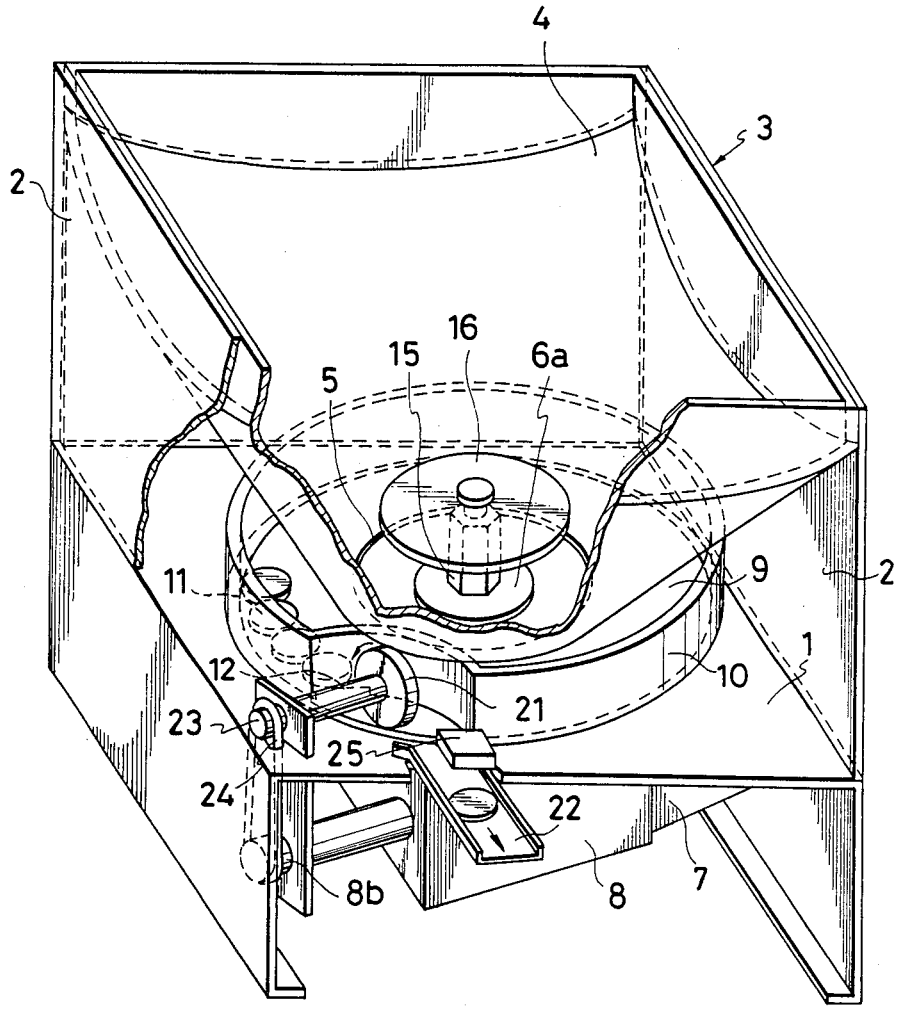
FIG. 1 is a perspective, partially cut-away view showing an embodiment of the present invention.

FIG. 1 is a perspective, partially cut-away view showing a coin dispenser according to the present invention. The coin dispenser shown in the drawings has a casing 3 formed by upstanding side walls 2 extending upwardly from four sides of a rectangular base 1, which is substantially horizontally disposed in the body of a slot machine or the like (not shown). In the casing 3, there is fixed a coin accommodating bucket 4 which is shaped like a funnel, the bottom of which is hollowed out circularly. At the center of circular opening 5 formed at the bottom of the bucket 4, a support shaft 6 is mounted to extend vertically to a predetermined height in the bucket 4. The support shaft 8 has a circular flange **6*a* formed at the lower end and fixed on a rotary disc 9 (mentioned later). Thus, the support shaft 6 is rotated with the rotary disc 9 as one body by a driving means which includes a gear box 8 and a motor 7 as a driving source. The driving means is provided under the base 1**.

Under the bucket 4 and above the base 1, the disc 9, which has the support shaft 6 mounted thereon is disposed to rotate horizontally. A cylindrical guide 10 is fixed so as to surround the circumference of the rotary disc 9. Though the guide 10 is disposed at a position near the circumference of the rotary disc 9 so that the disc can rotate, there may be a gap less than a radius of a coin 11 between a circumferential edge of the disc 9 and an inner cylindrical surface of the guide 10. Also, as apparent from FIGS. 1 and 2, the guide 10 has a transformed portion **10*a* entering on the rotary disc 9. The transformed portion 10*a* has a transverse slit 12 as a coin outlet at the lower fringe thereof. This slit 12 has a height and a width permitting only one coin 11** to pass through.

Figure 3:
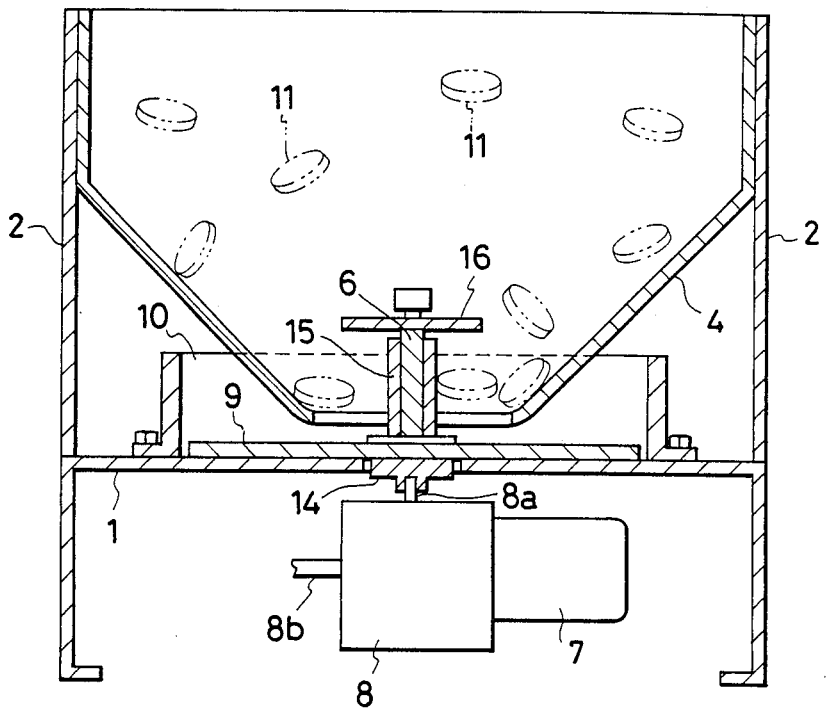
FIG. 3 is a sectional view taken on line III—III of FIG. 2.

Further, as shown in FIG. 3, the rotary disc 9 is placed on a mount 14 which is fixedly connected to an output shaft **8*a* of the gear box 8 and fixed between the end flange 6*a* of the support shaft 6 and the mount 14** by fasteners (not shown).

Figure 2:
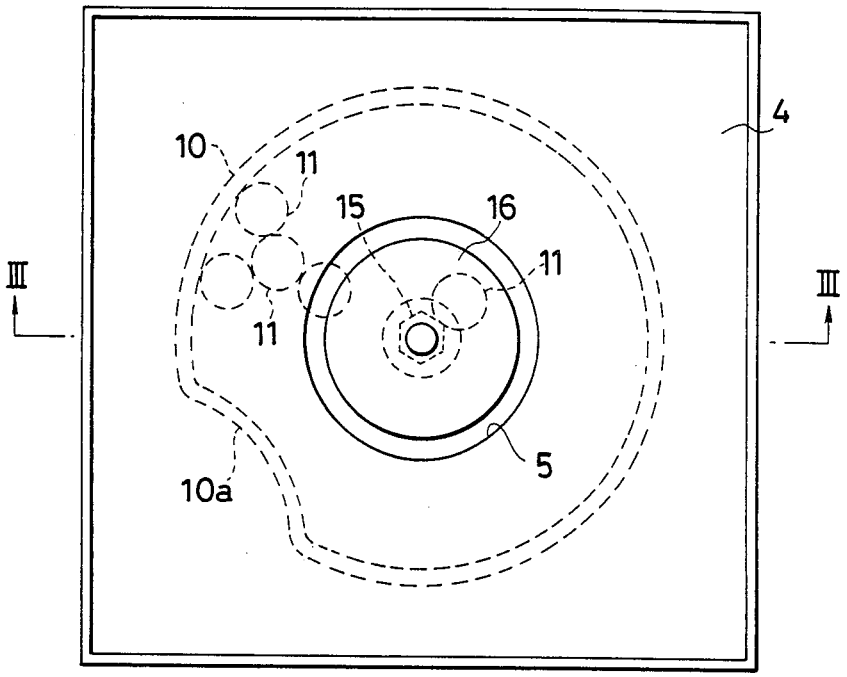
FIG. 2 is a plan view of the FIG. 1 embodiment.

Though the above-mentioned structure of the embodiment shown in the drawings is similar to conventional horizontal rotation type coin dispensers, according to the present invention, the coin dispenser has a hard elastic member having a non-circular section which rotates together with the rotary disc 9 disposed at the opening of the bottom of the bucket. As shown in FIG. 2, an elastic member 15 made of a hard rubber and having a hexagonal shape is attached to the side of the support shaft 6. Though the shape of such elastic member is preferably a polygon from triangle to hexagon, it may be another non-circular shape capable of colliding with and stirring the coins 11 which have fallen into the opening 5 of the bottom of the buck 4 (as mentioned later). Beside the polygons, the non-circular shape includes a shape partially rounded, such as a heart shape, for example. As the material of the elastic member 15, a hard material which is wear resistant or nondeformable by contact with the coins is preferably used.

A circular regulating board 16 is attached to the upper end of the support shaft 6 and is freely rotatable in horizontal direction but free from the rotation of the rotary disc 9. Thus, the regulating board 16 catches a large number of the coins 11 accommodated in the bucket 4 so that a load due to the weight of the coins may not be applied directly to the rotary disc 9. Even if the regulating board 16 is surrounded with a large number of coins, the rotary disc 9 can rotate free from it.

Near the outside of the slit 12 formed in the guide 10 is disposed a roller 21 which is made of an elastic material, such as rubber. This roller 21 is provided for sending the coins having passed through the slit 12 to a chute 22, and is rotatively driven by the output shaft 8*a* of the gear box 8 via a belt 24 rounded on a shaft 23 fixed with the roller 21. As shown in FIG. 1, when the roller 21 is disposed above the rotary disc 9, though it is preferable not to contact the roller 21 with the rotary disc 9, both of them may be in contact with each other if their rotations are made not to intervene each other by controlling the rotational rates of the rotary disc 9 and the roller 21 relatively.

Above the entrance of the chute 22 from the roller 21 is settled a sensor 25 for detecting the coins sent to the chute and counting the number of coins. As such coin sensor, for example, a photo-sensor or a magnetic sensor which detects passing of coins can be used.

The embodiment shown in the drawings is constituted as mentioned above and the action thereof is as follows.

When the rotary disc 9 is driven by the motor 7 via the gear box 8 and the output shaft 8*a*, the coins 11 accommodated in the bucket 4 fall onto the rotary disc 9 through the opening 5 of the bottom under the regulating board 16. At this time, as shown in FIG. 2, the corners of the elastic member 15 of the support shaft 6, which rotates in the opening, collides with the coins and flips them so that the coins are stirred, resulting in prevention of clogging of the coins. At the time of stirring, differing from conventional projection, because the side surface of the elastic member 15 contacts with the coins 11, the shock occured at collision is absorbed and because their contacting surfaces slide relative to each other, a part of the force applied to the elastic member by the coins can be lost. Therefore, stirring can be accomplished with a relatively small torque and biting into the coins hardly occurs.

Then, the coins 11 which have fallen onto the rotary disc 9 are moved to the circumference by a centrifugal force due to the rotation of the rotary disc 9 and the fringes of the coins are received by the guide 10. The coins are then transferred along the inner wall of the guide 10 together with rotary disc 9 to the outlet side. Also in transference of the coins, a large number of coins 11 provided on the rotary disc 4 are stirred by the elastic member 15 attached to the side surface of the support shaft 6, resulting in prevention of clogging of coins in the slit 12.

The coins transferred along the inner wall of the guide 10 to the outlet side pass through the slit 12 one after another at the transformed portion 10*a* and exhausted out of the guide 10. Each coin passed through the slit 12 is forced out by the rotating roller 21 and payed out into a receiver which leads outside of a slot machine or the like. On passing the coins from the roller 21 to the chute 22, the coin sensor actuates and detects the coins payed out.

Thus, the coins 11 are payed out one after another during the rotation of the rotary disc 9. The coin sensor 25 actuates at each time when the coin passes and pulse signals from the sensor 25 are inputted in a control circuit which is not shown in drawing. Thus, the number of coins payed out are counted. When the number of the coins reaches a predetermined number, the drive of the rotary disc 9 by the motor 7 is stopped to finish the coin pay out operation.

It is further understood by those skilled in the art that foregoing description is a preferred embodiment of the disclosed device and that various changes and modifications may be made in the invention without departing from the spirit and scope thereof. For example, it is possible that the regulating board may be supported by a means other than the support shaft, though in the embodiment mentioned above, the elastic member having non-circular cross section is attached to the side surface of the support shaft, by which the regulating board is supported. In the alternative case, the elastic member having non-circular cross section may be supported on the rotary disc.

What is claimed is:

1. A coin dispenser comprising:

a coin accommodating bucket having a bottom and an opening formed at the bottom, a rotatable disc disposed under said bucket and being substantially horizontally oriented for moving coins supplied from said bucket through said opening outwardly by centrifugal force, a guide surrounding the disc for guiding the coins moved outwardly due to centrifugal force and having an outlet to which the coins are guided, a shaft having a distal end portion and being mounted concentrically with said disc and extending upwardly through the opening at the bottom of the bucket into the bucket, a regulating board mounted on the distal end portion of the shaft for receiving the coins in said bucket over the opening, and an elastic stirring member having a non-circular cross section and being mounted on said shaft and rotatable together with said disc in the opening of the bottom of said bucket, and extending upwardly to a point near the regulating board.

2. A coin dispenser according to claim 1, wherein said elastic stirring member has a polygonal cross section.

3. A coin dispenser according to claim 2, wherein said elastic stirring member has a hexagonal cross section.

* * * * *

UNITED STATES PATENT AND TRADEMARK OFFICE

CERTIFICATE OF CORRECTION

PATENT NO. : 4,810,230

DATED : 3/7/89

INVENTOR(S) : Masaharu Shirasawa

It is certified that error appears in the above-identified patent and that said Letters Patent is hereby corrected as shown below:

Col. 1, line 17, "80°" should be --60°--;

Col. 1, line 20, after "to" insert --an--;

Col. 1, line 20, "an" should be --to--;

Col. 2, line 40, "8" should be --6--;

Col. 2, line 48, after "thereon" insert --,--;

Col. 3, line 12, "buck" should be --bucket--.

Signed and Sealed this

Twenty-sixth Day of September, 1989

*Attest:*

DONALD J. QUIGG

*Attesting Officer*

*Commissioner of Patents and Trademarks*